US007798861B2

(12) United States Patent
Liu et al.

(10) Patent No.: US 7,798,861 B2
(45) Date of Patent: Sep. 21, 2010

(54) ELECTRICAL CONNECTOR WITH TWO-PIECE CONFIGURED HOUSING

(75) Inventors: Su-Feng Liu, Kunshan (CN); Chin-Te Lai, Tu-Cheng (TW); Xin Yuan, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/436,802

(22) Filed: May 7, 2009

(65) Prior Publication Data

US 2009/0280687 A1 Nov. 12, 2009

(30) Foreign Application Priority Data

May 7, 2008 (CN) ..... 2008 2 0300693

(51) Int. Cl.
*H01R 17/00* (2006.01)

(52) U.S. Cl. ..... 439/660; 439/701; 439/874

(58) Field of Classification Search ..... 439/660, 439/701, 874

See application file for complete search history.

(56) References Cited

U.S. PATENT DOCUMENTS

| | | | | |
|---|---|---|---|---|
| 6,769,925 | B2 * | 8/2004 | Shibata et al. | 439/101 |
| 6,783,400 | B2 * | 8/2004 | Wu et al. | 439/660 |
| 7,029,330 | B1 * | 4/2006 | Ro | 439/607.01 |
| 7,385,665 | B2 * | 6/2008 | Matsumoto | 349/150 |
| 2001/0031565 | A1 * | 10/2001 | Sakiyama | 439/38 |
| 2006/0234542 | A1 * | 10/2006 | Ko | 439/495 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector (100) comprises a first insulative housing (10), a second insulative housing (30) engaging with the first insulative housing (10), and a plurality of contacts. Said second insulative housing (30) has a first platform (321) and a second platform (322) arranged at different levels. Each of the contacts (20) includes a mating portion (21) supported by the first insulative housing and a tail portion (23) supported by the second insulative housing, the tail portions (23) of the contacts are spaced into two rows and located on the first and second platforms; another contact has a tail portion disposed inside the second insulative housing.

17 Claims, 6 Drawing Sheets

ELECTRICAL CONNECTOR WITH TWO-PIECE CONFIGURED HOUSING

BACKGROUND OF THE INVENTION

1. Field of the Invention

The present invention generally relates to an electrical connector, and more particularly to an electrical connector with a two-piece configured housing.

2. Description of Related Art

Nowadays, miniaturization of electronic devices, such as notebooks, PDA, etc has become a trend such that the dimension and size of electronic connectors used therein have to be modified and reduced so as to meet the requirements.

A typical electrical connector comprises an insulative housing, a group of contacts received in the housing and a metal shielding assembled to the housing. Each contact defines a tail portion exposed beyond the insulative housing. It's difficult to solder the contact with a corresponding wire automatically, in manual soldering process, additional tubes are needed to prevent short circuit, so it's inconvenient for manufacturing the electrical connector.

Hence, it is desirable to have an improved structure to overcome the above-mentioned disadvantages of the prior art.

BRIEF SUMMARY OF THE INVENTION

Accordingly, the object of the present invention is to provide an electrical connector with a two-piece housing for soldering conveniently and preventing short circuit.

In order to achieve the above-mentioned object, an electrical connector in accordance with the present invention comprises a first insulative housing, a second insulative housing engaging with the first insulative housing, and a plurality of contacts. Said second insulative housing has a first platform and a second platform arranged at different levels. Each of the contacts includes a mating portion supported by the first insulative housing and a tail portion supported by the second insulative housing, the tail portions of the contacts are spaced into two rows and located on the first and second platforms; another contact has a tail portion disposed inside the second insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
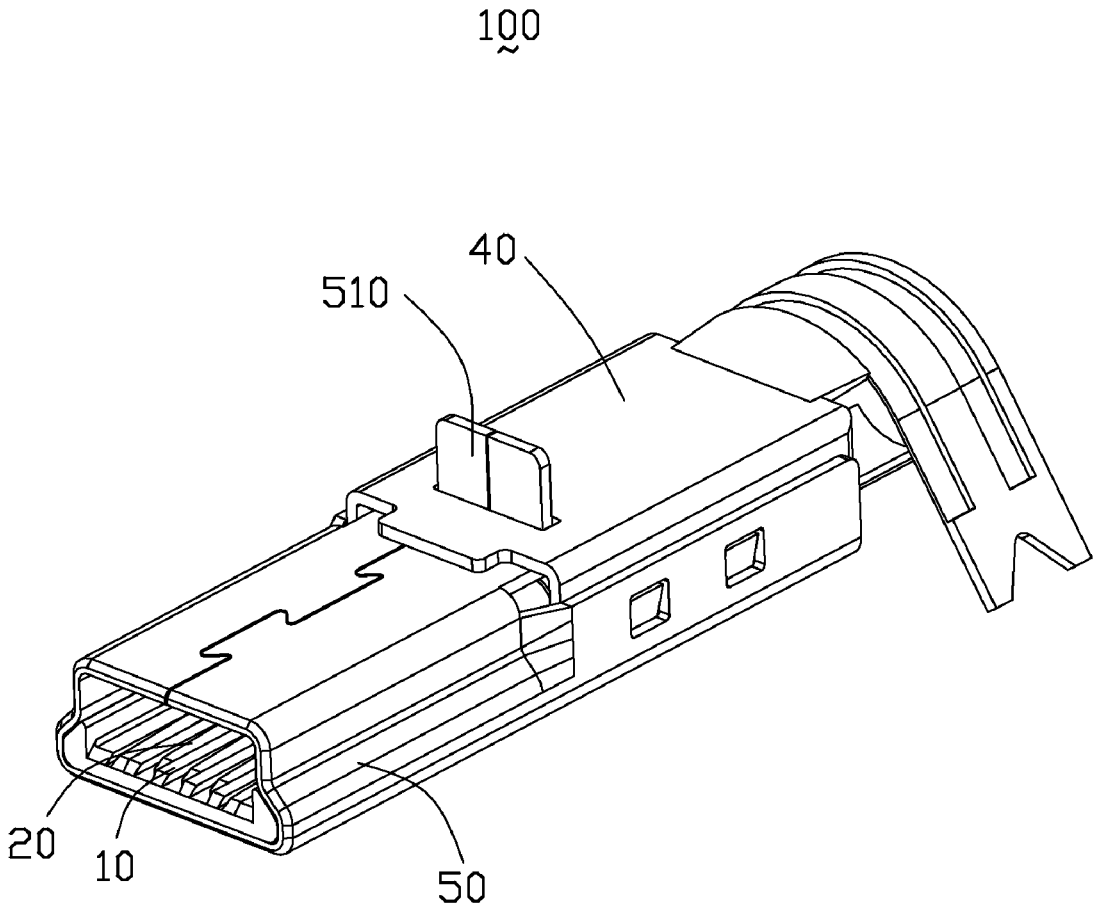
FIG. 1 is an assembled view of an electrical connector in accordance with the present invention.

Reference will now be made to the drawing figures to describe the present invention in detail.

Figure 2:
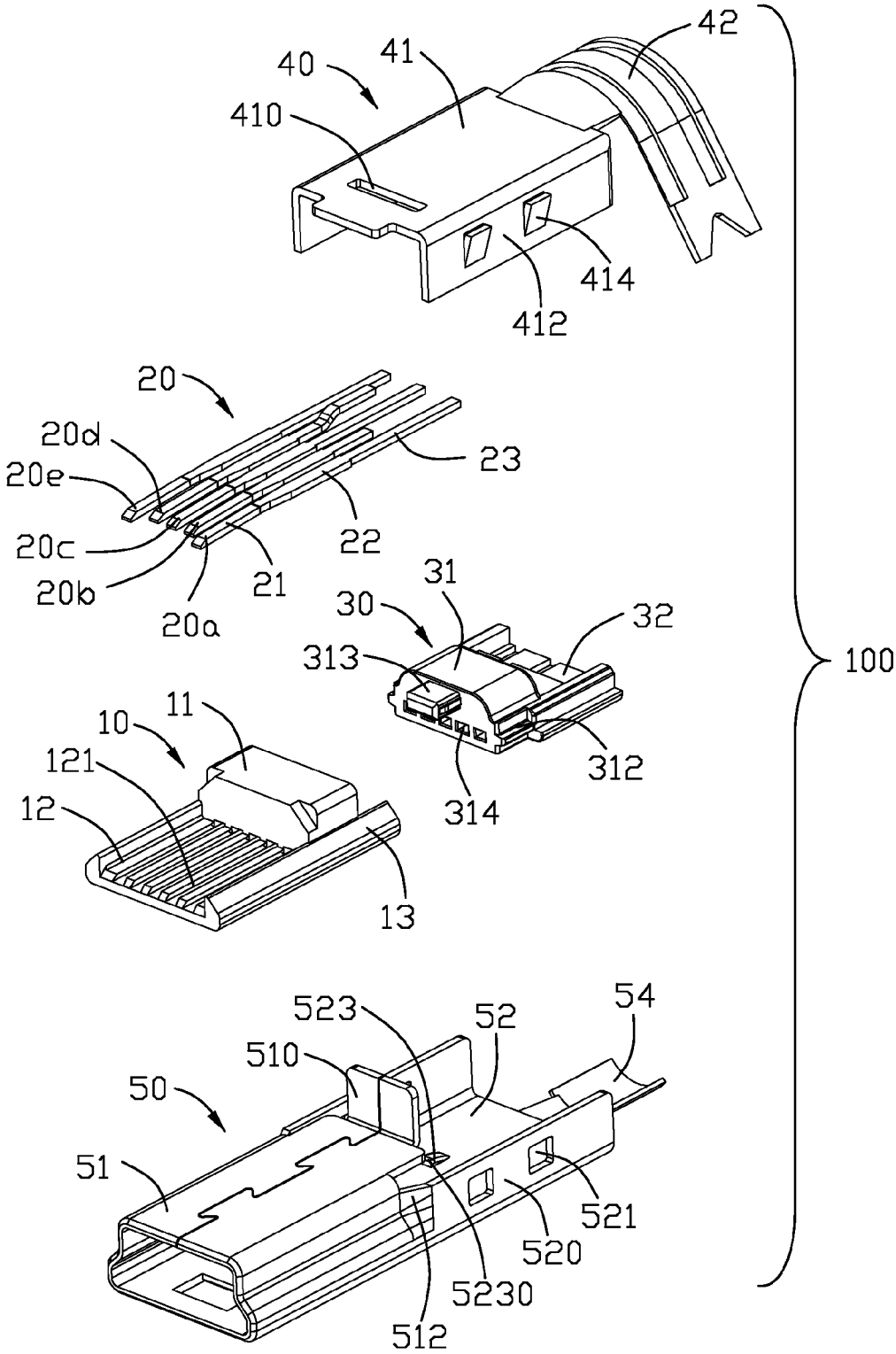
FIG. 2 is an exploded view of FIG. 1.

Referring to FIGS. 1-2, an electrical connector 100 in accordance with the present invention comprises a first housing 10, a contact set 20 inserted into the first housing 10, a second housing 30 assembled to the first housing 10 for supporting tail portions 23 of the contact set 20, a bottom shell 50 enclosing the first housing 10 and a top shell 40 assembled to a back portion of the bottom shell 50 along a up-to-down direction.

Figure 3:
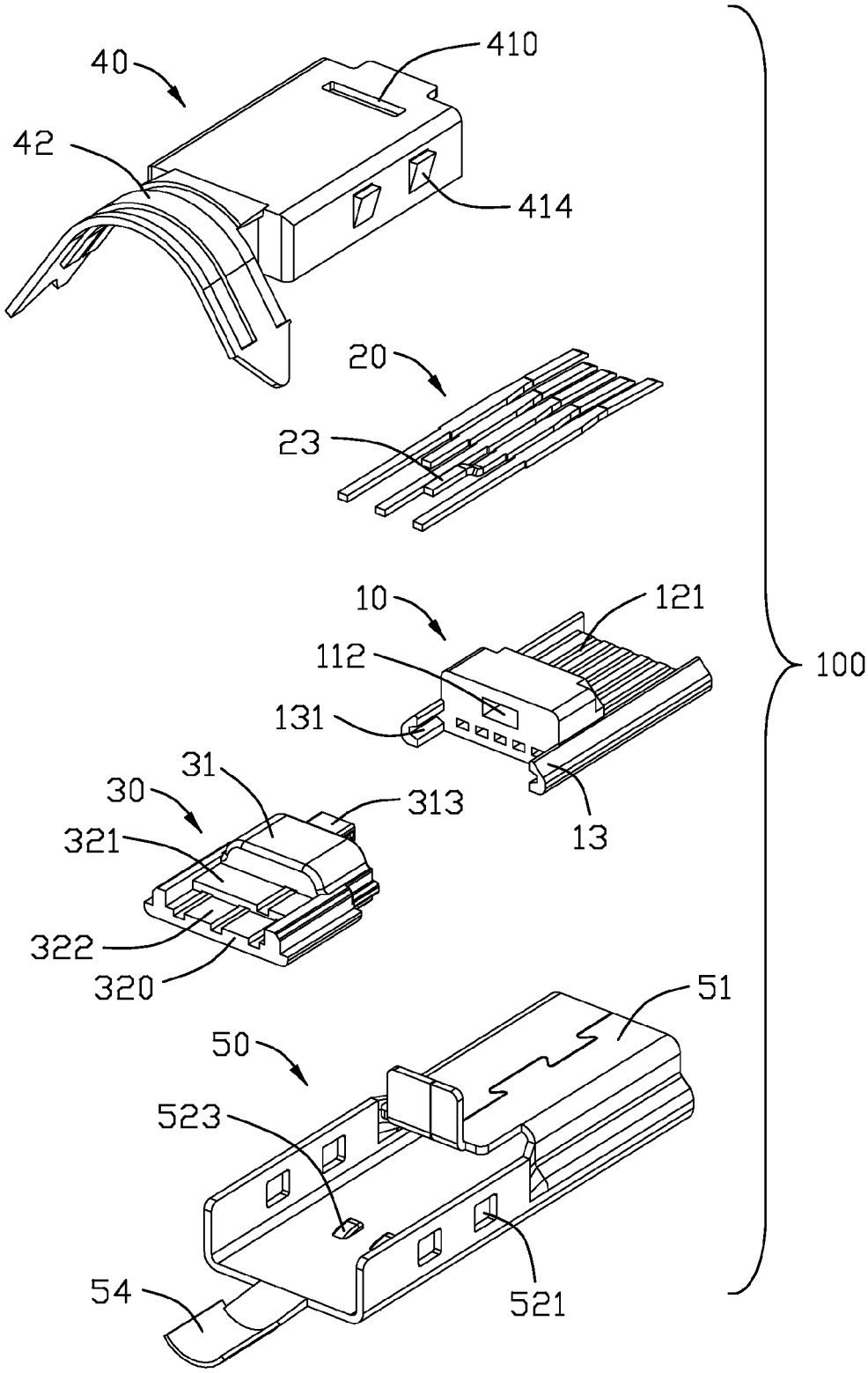
FIG. 3 is a view similar to FIG. 2, but viewed from a different angle.

Referring to FIGS. 2-3, the first housing 10 is made of insulative material, and comprises a base portion 11, a U-shape tongue 12 extending forwardly from the base portion 11 along a mating direction and a pair of arms 13 extending rearwards from the base portion 11. The arms 13 respectively define a leading slot 131, and the pair of leading slots 131 are opposite to each other. A plurality of passageways 121 are defined in the tongue 12, the passageways 121 extend to the base portion 11 and then penetrate through thereof. The base portion 11 defines an engaging hole 112 recessed forwardly from a back side thereof.

The contact set 20 comprises five contacts arranged side-by-side in the lateral direction and respectively numbered as 20*a* to 20*e*. Each contact comprises a contacting portion 21 for electrically connected with a complementary connector (not shown), a retention portion 22 extending rearwards from the contacting portion 21, and a tail portion 23 extending rearwardly from the retention portion 22. The contacting portions 21, the retention portions 22 and the tail portions 23 of the contact set 20 are at a same plane except the contact 20*d*. The two contacts 20*a*, 20*e* located at lateral sides of the contact set 20 have longer contacting portions 21. The second contact 20*b* on left is partially cut to form the tail portion 23 shorter than the other. The tail portion 23 of the fourth contact 20*d* on left is firstly bent upwards then extending horizontally to locate at a first plane, the tail portions 23 of the contact set 20 except the contact 20*d* locate at a second plane lower than the first plane, in this manner, a distance between the adjacent contacts is larger for soldering the contacts to wires (not shown) without circuit short problem.

Referring to FIGS. 2-6, the second housing 30 is made of insulative material, and comprises a main body 31 and a supporting portion 32 extending rearwards from the main body 31. The main body 31 is thicker than the supporting portion 32 and defines a protruding member 313 extending forwardly from a front surface thereof, the protruding member 313 is arranged adjacent to a top edge of the main body 31. A pair of leading ribs 312 are defined at lateral sides of the main body 31. A plurality of receiving slot 314 are arranged below the protruding member 313 and respectively numbered as 314*a* to 314*e* from right to left. The receiving slot 314*d* is larger than the other ones. The supporting portion 32 comprises a first platform 321 and a second platform 322 lower than the first platform 321, the second platform 322 is protruded beyond back end of the first platform 321. The receiving slot 314*d* penetrates rearwards the main body 31 and the back end thereof located in the first platform 321, the receiving slot 314*b* penetrates rearwards the main body 31 to a certain distance and terminates in the supporting portion 32.

The bottom shell 50 comprises a sleeved portion 51, a U-shaped extension portion 52 extending backwards from the sleeved portion 51 and a sustaining portion 54 extending rearwards from the extension portion 52. The sleeve portion 51 is bending upwards to form a locking tab 510, both sides of the sleeve portion 51 are connected with first lateral walls 520 of the extension portion 52 by inclined conjoint portions 512. The extension portion 52 defines a block 523 on a inner wall thereof, the first lateral wall 520 defines a pair of receiving holes 521.

The top shell 40 comprises a U-shaped casing portion 41 and a wrapping portion 42 located behind the casing portion 41, the casing portion 41 defines a locking hole 410 along a transverse direction and a pair of second lateral walls 412, the locking hole 410 is in front end of the casing portion 41. The second lateral wall 412 defines a pair of protrusions 414 corresponding to the receiving holes 521.

Figure 4:
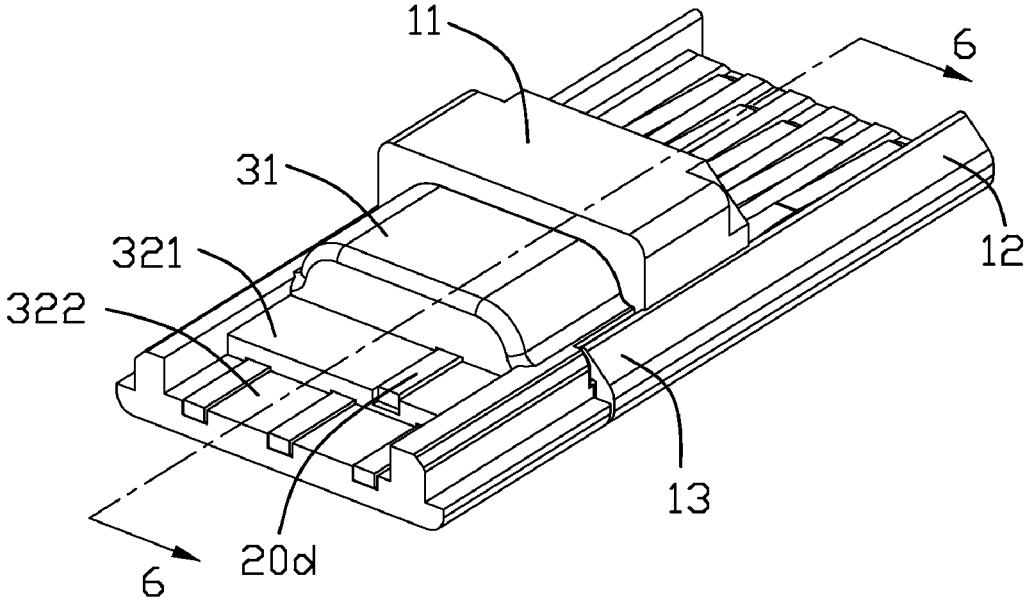
FIG. 4 is an assembled view of the electrical connector, with shells thereof removed away.
Figure 5:
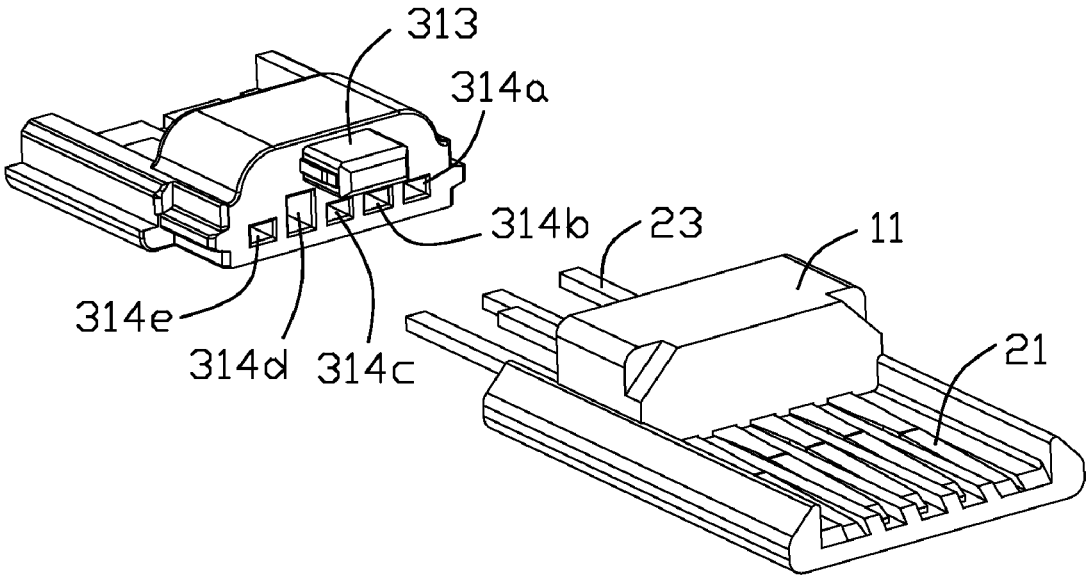
FIG. 5 is a partially exploded view of FIG. 4.
Figure 6:
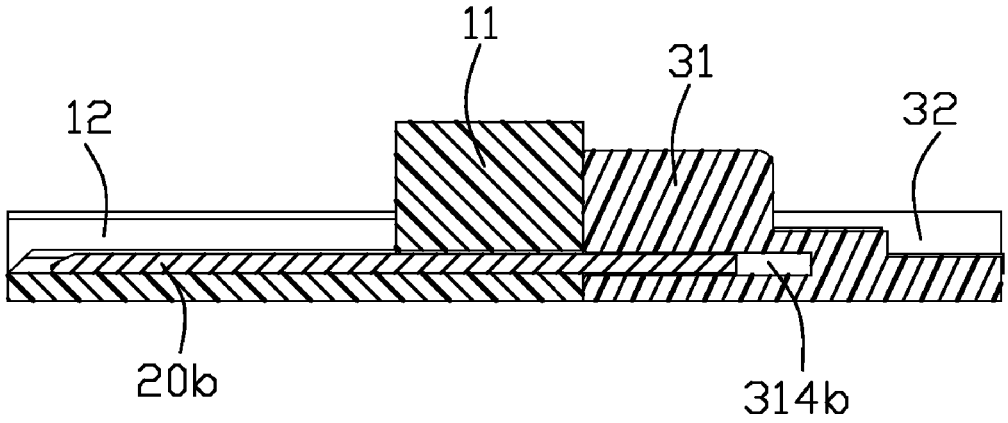
FIG. 6 is a cross-section view of FIG. 4 taken along line 6-6.

Referring to FIG. 1 and conjunction with FIG. 4, in assembling, the contact set 20 is inserted into the first housing 10, the contacting portions 21 of the contact set 20 are received in the passageways 121 of the first housing 10, the retention portions 22 are retained in the base portion 11. The second housing 30 is assembled to the first housing 10 along a back-to-front direction, the leading ribs 312 slide along the leading slots 131, the protruding member 313 is received in the engaging hole 112. Tail portions 23 are received in the receiving slots 314 of the second housing 30, the tail portion 23 of the fourth contact 20*b* is received in the receiving slot 314*b*, the main body 31 is longer enough to close in the tail portion 23 of the contact 20*b*, so that the tail portion 23 of the contact 20*b* is not exposed on the supporting portion 32.

Then wires (not shown) are soldered to the tail portions 23 of the contact set 20, the first housing 10, the second housing 30 with the contact set 20 and the wires are assembled to the bottom shell 50 along the back-to-front direction, a rear surface 320 of the second housing 30 is adjacent to a front surface 5230 of the block 523. The tongue 12 and the base portion 11 of the first housing 10 are located in the sleeved portion 51 of the bottom shell 50, the second housing 30 is located in the extension portion 52, the wires are located on the sustaining portion 54. The top shell 40 is assembled to the extension portion 52 of the bottom shell 50 along the up-to-down direction, the locking tab 510 is protruding into the locking hole 410, the protrusions 414 are positioning in the corresponding receiving holes 521, the wrapping portion 42 encloses the wires together with the sustaining portion 54.

Then, a cover (not shown) is over-molded on the above-mentioned component. Therefore, the electrical connector 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a first insulative housing and a second insulative housing engaged with the first insulative housing, said second insulative housing having a first platform and a second platform arranged at different levels;

a plurality of contacts, each of the contacts including a mating portion supported by the first insulative housing and a tail portion supported by the second insulative housing, the tail portions of the contacts spaced into two rows and located on the first and second platforms; and another contact having a tail portion disposed inside the second insulative housing.

2. The electrical connector of claim 1, wherein the tail portion of the another contact is located at a same level as the tail portions arranged on the second platform.

3. The electrical connector as claimed in claim 1, wherein the first insulative housing defines a pair of arms extending rearwardly, and the arms define a leading slot respectively.

4. The electrical connector as claimed in claim 3, wherein the second insulative housing defines a main body in front of the first platform, and the main body is thicker and longer than a supporting portion formed by the first platform together with the second platform.

5. The electrical connector as claimed in claim 4, wherein the main body defines a pair of leading ribs at lateral sides, and the second housing is assembled to the first housing with the leading ribs sliding along the leading slot.

6. The electrical connector as claimed in claim 1, wherein the first insulative housing defines an engaging hole recessed forwardly from a back end thereof the second housing defines a protruding member extending forwardly, and the protruding member cooperates with the engaging hole.

7. The electrical connector as claimed in claim 1, further comprising a top shell and a bottom shell, wherein a plurality of protrusions are arranged at lateral sides of the top shell.

8. The electrical connector as claimed in claim 7, wherein the bottom shell has a plurality of receiving holes cooperating with the corresponding protrusions.

9. The electrical connector as claimed in claim 8, wherein a locking hole is defined in the front of the top shell along a transverse direction.

10. The electrical connector as claimed in claim 9, wherein the bottom shell defines a locking tab received in the locking hole.

11. The electrical connector of claim 7, wherein the bottom shell defines a block on an inner wall thereof, and a rear surface of the second housing is adjacent to a front surface of the block.

12. An electrical connector, comprising:

a first housing defining a plurality of passageways;

a contact set comprising a plurality of contacts received in the passageways of the first housing, each contact comprising a contacting portion and a tail portion; and a second housing combined to the first housing and comprising a first platform and a second platform both extending rearwardly, the first platform and the second platform parallel to each other, the second platform lower than the first platform, tail portions of partial contacts arranged on the second platform, tail portion of one rest contact bent upwards to be exposed on the first platform, tail portion of another contact closed in the second housing.

13. The electrical connector as claimed in claim 12, wherein the second housing defines a plurality of receiving slots, and the tail portions of the contacts are received in the receiving slots.

14. The electrical connector as claimed in claim 13, wherein one of the receiving slots is in the first platform to receive the contact bending upwards.

15. The electrical connector as claimed in claim 13, wherein the one contact closed in the second housing is shorter than the others.

16. An electrical connector comprising:

a first insulative housing defining a plurality of first passageways;

a second insulative housing assembled to a rear side of the first housing and defining a plurality of second passageways corresponding to the first passageways, respectively;

a plurality of contacts each defining a front contacting section forwardly extending into the corresponding first passageway and a rear soldering section rearwardly extending into the corresponding second passageway; wherein the soldering section of a specific one of said contacts is terminated and hidden in the second housing while those of the remaining contacts further extend rearwardly out of the second housing for being exposed to a corresponding wire for soldering.

17. The electrical connector as claimed in claim 16, wherein all said second passageways are aligned with the corresponding first passageways in a front-to-back direction and a vertical direction perpendicular to said front-to-back direction except one which defines a raised portion for accommodating an upwardly deflection soldering section of the corresponding contact.

* * * * *